United States Patent [19]

Julius

[11] 4,156,493

[45] May 29, 1979

[54] RECLOSEABLE DISPENSER PACKET

[75] Inventor: Robert P. Julius, New York, N.Y.

[73] Assignee: Nice-Pak Products, Inc., Mount Vernon, N.Y.

[21] Appl. No.: 668,682

[22] Filed: Mar. 19, 1976

[51] Int. Cl.[2] ..... A47K 10/20

[52] U.S. Cl. ..... 221/63; 206/613

[58] Field of Search ..... 118/43; 221/63, 48; 222/541; 229/51 D, 62; 206/205

[56] References Cited

U.S. PATENT DOCUMENTS

| | | | |
|---|---|---|---|
| 2,573,309 | 10/1951 | Chipkevich | 221/63 |
| 3,235,165 | 2/1966 | Jackson | 221/63 X |
| 3,383,012 | 5/1968 | Adell | 221/63 |
| 3,711,011 | 1/1973 | Kugler | 229/51 D |
| 3,749,296 | 7/1973 | Harrison | 225/106 |
| 3,784,055 | 1/1974 | Anderson | 221/63 |
| 3,862,703 | 1/1975 | Dutcher | 221/63 |
| 3,918,608 | 11/1975 | Faller | 221/63 |

*Primary Examiner*—Stanley H. Tollberg
*Attorney, Agent, or Firm*—Gottlieb, Rackman & Reisman

[57] ABSTRACT

A recloseable dispenser packet is disclosed wherein articles, such as moisture impregnated towelettes, are readily accessible to the user. Both semi-rigid and flexible embodiments of the invention are described, and each embodiment employs a resealable closure whereby the packet may be opened for dispensing of individual towelettes and thereafter closed to maintain the packet in a hermetically sealed condition.

3 Claims, 8 Drawing Figures

RECLOSEABLE DISPENSER PACKET

BACKGROUND OF THE INVENTION

1. Field of the Invention:

The present invention is directed to a moisture impermeable packet containing moisture impregnated articles that are accessible through a resealable opening for individual dispensing.

2. Description of the Prior Art:

Substantially wet sheets, tissues, or towelettes, such as are generally utilized for personal hygiene, cosmetic purposes, houshold cleaning applications and the like, have gained great popularity over the past several years. However, the containers used for storage of these items have generally been designed for bulk storage, of a large number of items, or for individual storage, of one item.

Each of the prior art techniques for packaging fail to satisfy a need for providing an inexpensive hermetically resealable packet for storing a small number of towelettes convenient for carrying in a pocket or purse.

U.S. Pat. No. 3,780,908 to Fitzpatrick et al, U.S. Pat. No. 3,836,044 to Tilp et al and U.S. Pat. No. 3,841,466 to Hoffman et al each provide for moisture-impermeable packages with sealing lid means to prevent moisture-impregnated towelettes from drying out, before they are dispensed. Each of the packages in the above-cited patents are concerned with bulk packaging, wherein a large number of sheets or towelettes are stored at one time. Such bulk packaging techniques are not readily convertible to satisfy the limitations imposed upon the packaging of a small number of towelettes.

Other moisture-impermeable packaging techniques have been shown in U.S. Pat. No. 3,784,056 to Spruyt et al and U.S. Pat. No. 3,862,703 to Dutcher.

In the Spruyt patent, a semi-rigid tray like container is shown with two overlapping thin, flexible materials attached to the outer edges of the tray. The overlapping sections of the flexible materials define a slit closure, which is elongated in a predetermined direction. The container is differentially stressed to apply a slit-sealing tension force in the direction of the slit elongation and the overlapping material sections to effect a substantially moisture-impermeable closure. It is apparent that the sealing system of the Spruyt patent does not provide for a positively sealed container since a relief of the tension forces by inadvertent compression of the ends of the container may easily cause the sealing relationship to be destroyed.

The Dutcher patent shows a recloseable plug-type dispensing package wherein a tray of sheet plastic is used as a container for liquid impregnated wiping tissue. The tray includes a bottom wall and upwardly inclined end and side walls having a commonly planar flange edge over which a heat sealable paperboard is sealed thereto to provide a top for the dispenser package. The top is provided with a weakened portion which forms an opening to access the towelettes in the tray. When the opening is formed and the portion of the paperboard top is removed, a plug is used to fill the opening and provide a sealing means for the package. It is apparent that the Dutcher patent presents a packaging technique which is both complicated in its construction and in its use.

SUMMARY OF THE INVENTION

The present invention is intended to overcome the problems of the prior art by presenting a hermetically resealable personal size packet for containing a convenient number of moisture impregnated items, such as towelettes. The personal size packet of the present invention is convenient to carry in a purse or pocket, overcomes the bulkiness of the prior art containers and eliminates the waste and expense generated by the prior art packaging of individual towelettes.

It is an object of the present invention to provide a hermetically sealed packet for containing moisture impregnated items, which is both economic to make and convenient to carry in a purse or pocket.

It is an object of the present invention to provide a hermetically sealed packet having a resealable closure means for allowing the removal of moisture impregnated items and allowing the packet to be hermetically resealed.

It is an object of the present invention to provide a hermetically resealable packet, which is both easily constucted and easy to use.

DESCRIPTION OF THE PREFERRED EMBODIMENTS

The present invention provides for a novel hermetically sealed packet for containing items which must necessarily be protected from the atmosphere. Such items include moisture impregnated towelettes which may be made from a variety of materials including paper, fabric (non-woven or woven) or sponge. Other items which may be contained within the packet of the present invention include all families of liquid products, from water based solutions to solvent based liquids, having viscosities which range from free flowing liquids to lotions and creams. Although the range of usage and application of the present invention will be obvious from the following disclosure, the following description is made with respect to moisture impregnated towelettes which are folded and stacked in the packet so as to present a free edge accessible through a resealable closure to thereby facilitate the withdrawal of individual towelettes therefrom.

Figure 1A:
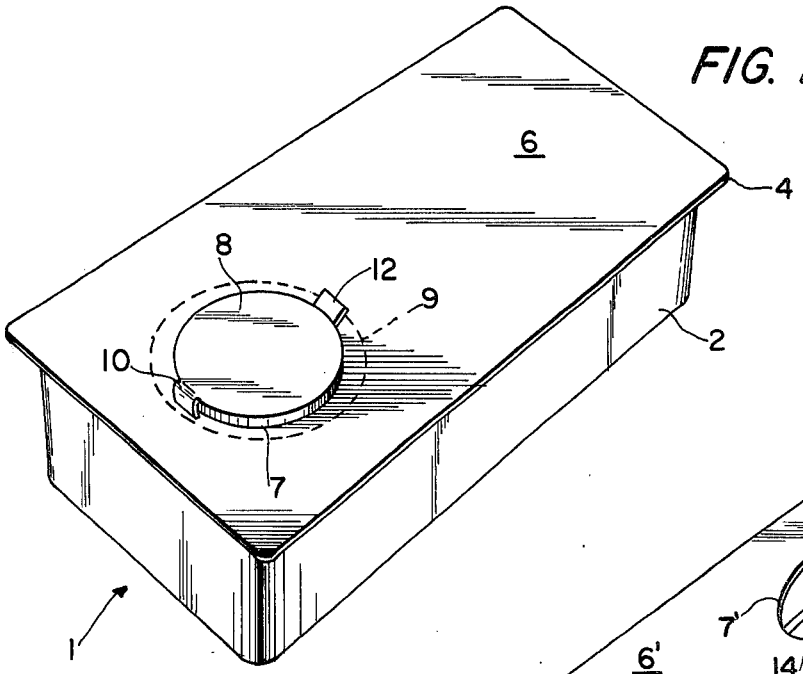
FIG. 1A shows a first embodiment of the present invention employing a semi-rigid container with a hermetically sealed top and recloseable cap.

FIG. 1A shows a first embodiment of the present invention wherein the packet 1 is formed of a semi-rigid container 2. The container 2 is generally rectangular in shape having side walls which extend from the bottom thereof in an upward direction terminated by a flange edge 4 at the top thereof. The semi-rigid container 2 is preferably made of a vinyl material or the like which may be thermo-formed or injection molded.

A thin, flexible material 6, such as vinyl film or aluminum foil or any other material which provides a high moisture vapor barrier, is sealed to the flange 4 of the container 2 by conventional sealing methods (i.e., heat, ultrasonic or adhesive sealing). The thin, flexible material 6 is provided with an opening 7, through which the contents of the packet 1 may be accessed by the user.

In FIG. 1A a resealable cap is shown attached to the thin, flexible material 6 through the opening 7 and thereby provides a reclosing mechanism to maintain the container in a hermetically sealed condition. The cap 8 is preferably constructed as a single unit with a flexible "living" hinge 10, a pull tab 12 and a lower collar 9. (It is understood that cap 8, the pull tab 12, the hinge 10 may be separate elements with respect to the lower collar 9 and would necessarily be assembled to form a single unit.) The collar 9 is attached to the underside of the thin, flexible material 6 by applying an adhesive therebetween. In the alternative, other well known methods such as heat sealing or ultrasonic sealing may be used to attach the collar 9 to the material 6. The method of attaching the collar 9 to the material 6 is not a critical part of the invention, so long as the contents of the container are maintained in a heremetically sealed condition, when the cap 8 is closed.

Figure 1B:
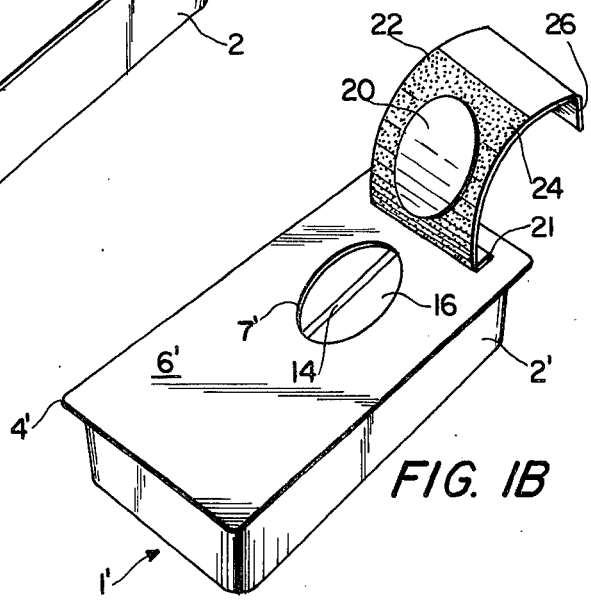
FIG. 1B shows a second embodiment of the present invention similar to that shown in FIG. 1A, with an adhesive type resealable closure.

FIG. 1B shows a second embodiment of the present invention similar to that shown in FIG. 1A (like elements are indicated in prime notation). The packet 1' is constructed in a similar fashion to the embodiment of FIG. 1A, but provides an alternative closure concept. In the embodiment shown in FIG. 1B, the flexible material 6' is shown with a discontinuous area defining an opening 7' therein. Preferably, the defined opening 7' is die cut, or perforations are cut into the material 6' to form the general outline of the opening 7'. The opening 7' may take the form of a circle, an oval, a slit or any other desired shape which will be evident from the following disclosure.

A closure flap 22, which is preferably made of a moisture impermeable material similar to material 6', (but may also be made from a woven material) is permanently attached, at one end thereof, to the material 6' in a conventional manner to form a hinge 21. The closure flap 22 is attached to the material 6' in an orientation, with respect to the opening 7', that allows the flap 22 to extend over and surround the opening 7', when the flap 22 is lying flat thereover. The flap 22 contains a non-hardening contact adhesive coating 24 which extends from the hinge 21 to an area designated as an end pull tab 26. The area covered by the adhesive 24 corresponds to the area of the opening 7' and an area surrounding the opening 7'. The flap 22 is thereby pressure sensitive and provides a hermetic seal to the contents 16 of the container 1', since the flap 22 is flexibly hinged to lie flat over the flexible material 6' and be adhesively attached thereto over the area covered by the adhesive 24. When a user pulls on the tab 26 in an upward manner, the flap 22 is thereby rotated withdrawing the die cut portion 20 (defined as the material 6' outlined by the opening 7'). The user causes the flap 22 to rotate until an opening 7' is exposed sufficiently to allow withdrawal the contents of the packet 1' (indicated as folded moisture impregnated towelettes 16 having a free edge 14). The packet 1' is then resealed by rotating the flap 22 so that it again adhesively attaches to the upper surface of the material 6'. The portion 20 therefore returns to its original position in the opening 7' and the packet 1' is sealed around the opening 7' by the adhesive area 24 of the flap 22.

Figure 2:
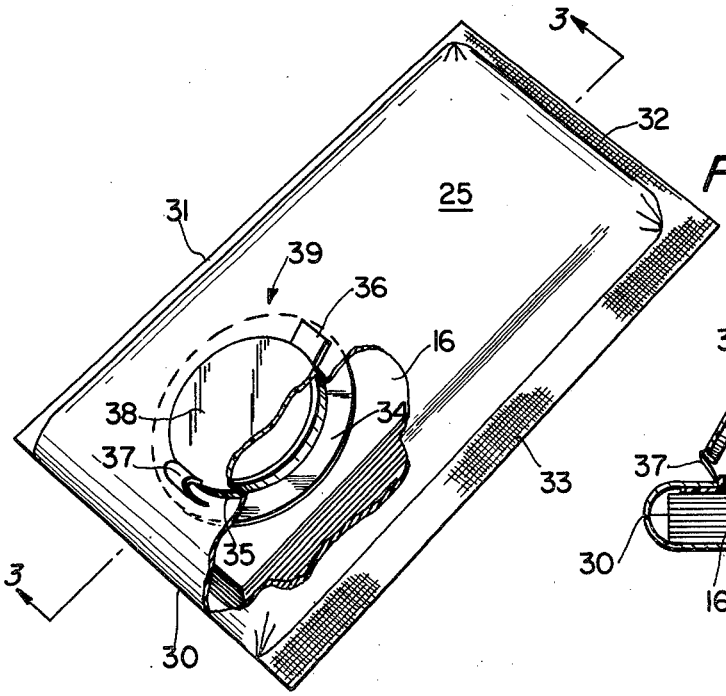
FIG. 2 shows a third embodiment of the present invention wherein a hermetically sealed flexible container employs a resealable cap.
Figure 3:
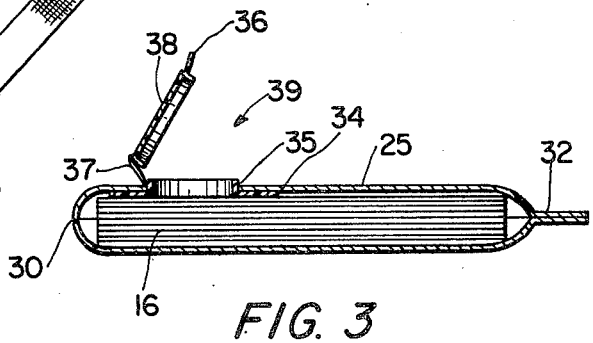
FIG. 3 shows a cross-section of the container shown in FIG. 2.

A third embodiment of the present invention is shown in FIG. 2, with a cross-section thereof shown in FIG. 3. FIGS. 2 and 3 show a flexible packet 25 formed of a single sheet of flexible material, such as a vinyl film, foil or any other flexible material which can be permanently sealed to provide a hermetically sealed container.

A discontinuous area defining an opening 35 is formed in the flexible material, preferably before the packet 25 is formed. The opening 35 is of sufficient size to allow a resealable cap assembly 39 to protrude therethrough and to be attached to the flexible material.

A resealable cap assembly 39 shown in FIGS. 2 and 3 has a resealable cap 38 being connected to a flexible "living" hinge 37. A pull tab 36 is formed on the cap 38 and the hinge 37 is attached to a collar 34. The collar 34 of the cap assembly 39 is preferably attached to a surface of the flexible material by one of the methods suggested in the discussion of the embodiment shown in FIG. 1A.

The packet 25 is formed about the towelettes by folding the flexible material along a median line defining a fold edge 30 and sealing the folded flexible material along exposed edges 31, 32 and 33. The packet 25 is sealed by a conventional method, such as heat sealing, ultrasonic sealing, or by using a strong adhesive, to obtain a permanent seal.

The resealable cap assembly 39 thereby provides a means for exposing the towelettes 16 for access by a user and also provides a resealing means whereby the moisture impermeated towelettes 16 remaining in the packet 25 may be maintained in a hermetically sealed condition.

Figure 4A:
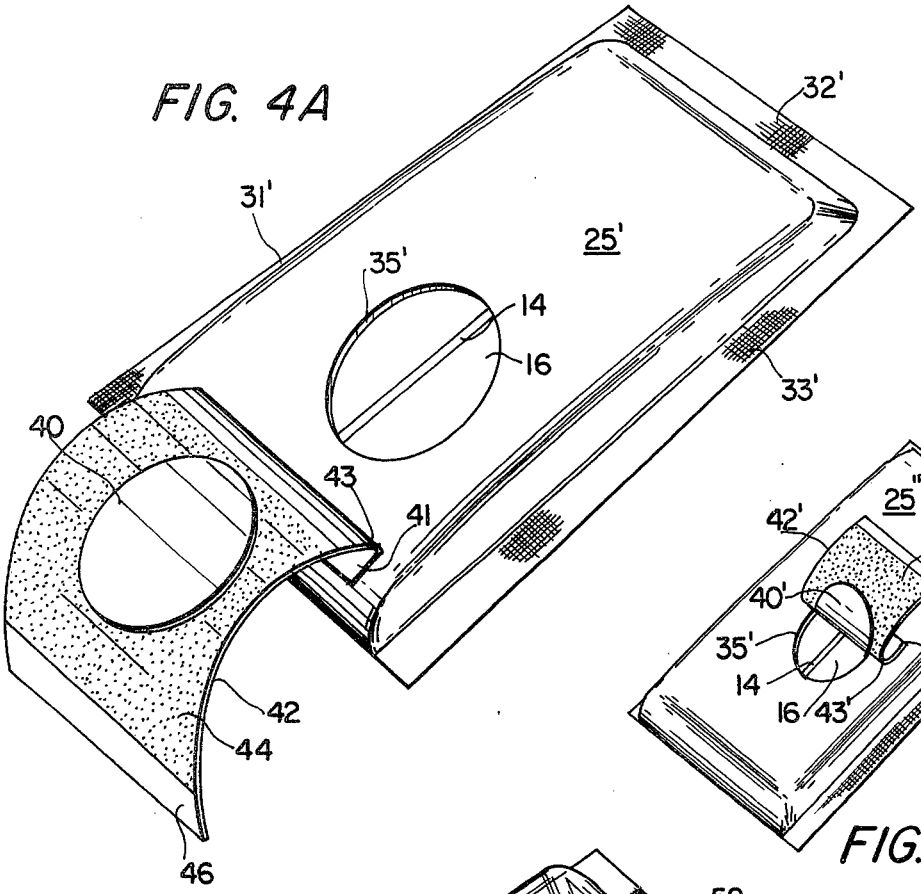
FIG. 4A shows a fourth embodiment of the present invention wherein a hermetically sealed flexible container employs an adhesive type resealable closure.

FIG. 4A presents a flexible towelette packet embodiment similar to that shown in FIGS. 2 and 3 (like elements are indicated in prime notation). The flexible packet 25' is sealed about edges 31', 32' and 33' to form a hermetically sealed packet. The contents, shown here as moisture impregnated towelettes 16, are enclosed within the sealed packet 25'. A discontinuous area defining an opening 35' is formed on one surface of the packet 25' by a die cut or perforations cut into the material forming the packet 25'.

In this embodiment, a flap 42 is permanently attached, at one end 41 thereof, to the packet 25', thereby defining a flexible hinge 43. The flap 42 is quite similar to that shown in FIG. 1B and contains a non-hardening contact adhesive 44 covering an area which is greater than the size of the defined opening 35'. A pull tab 46 is also defined on the flap 42 as an area free of adhesive 44. During construction of the packet 25', the flap 42 is permanently attached at 41 and oriented to cover the defined opening 35'. Therefore, when the packet 25' is first opened, the die cut portion 40 of the flexible material in the defined opening 35' becomes separated from the opening 35' and remains adhesively attached to the flap 42, thereby allowing one to access and remove the towelettes 16 by fold edge 14.

Figure 4B:
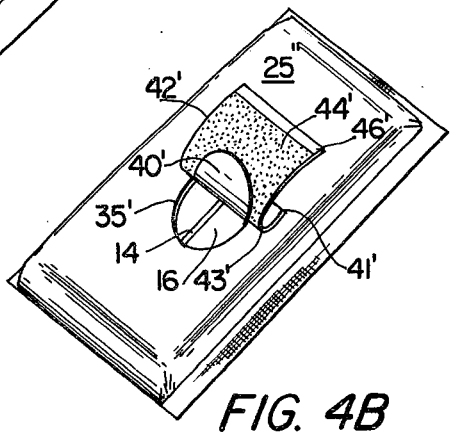
FIG. 4B shows a fifth embodiment of the present invention similar to that shown in FIG. 4A, with a centrally located resealable closure.

FIG. 4B indicates an embodiment similar to that shown in FIG. 4A. In this embodiment, a packet 25'' has a flap 42' permanently attached thereto at 41' to provide a flexible hinge 43'. In this embodiment, the discontinuous area defining an opening 35' is formed by an incomplete die cut, wherein a die cut portion 40' is not detachable from the material forming packette 25''. In this case, the flap 42' may be rotated in an upward direction with respect to the packet 25, the die cut portion 40' is rotated with the flap 42' and does not become detached from the opening 35'' or the material forming packet 25''.

Figure 5A:
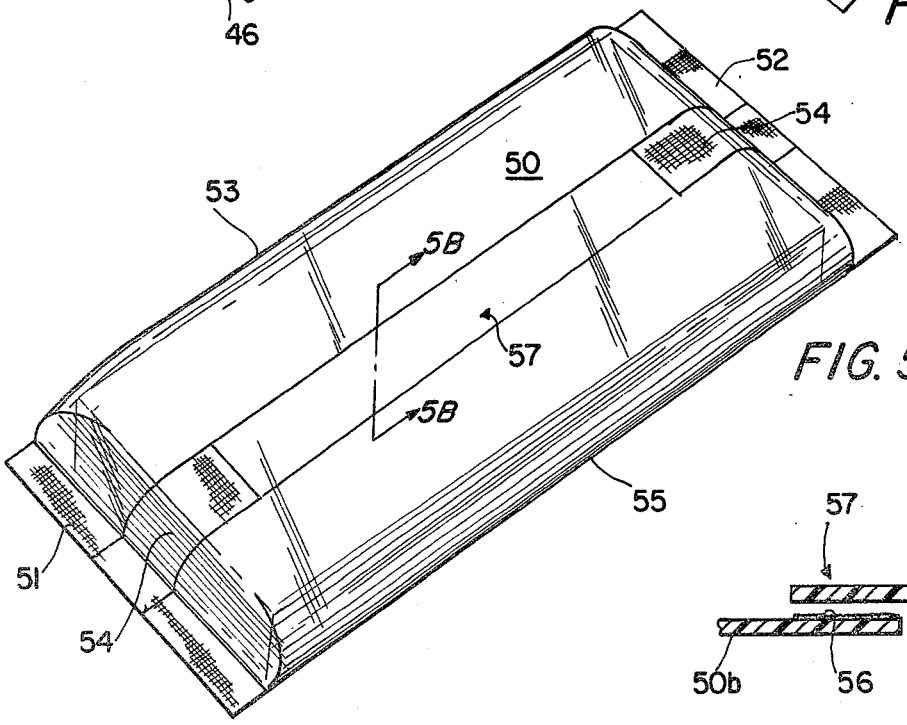
FIG. 5A shows a sixth embodiment of the present invention wherein a hermetically sealed flexible container employs a resealable seam.

A further embodiment of the present invention is shown in FIG. 5A. A packet 50 is formed of a single sheet of flexible material similar to that employed in a construction of the embodiments shown in FIGS. 2, 3, 4A and 4B. In this case, a single sheet of flexible material having two substantially parallel edges is folded along fold edges 53 and 55 to enclose the towelette contents. An overlapping seam 54 is formed, by the two parallel edges, which runs lengthwise over the packet 50. A portion of the seam 54, designated as 57, provides a resealable closure 57, wherein access can be made to the contents of the packet 50. The packet 50 is permanently sealed along edges 51 and 52 in order that the contents will remain hermetically sealed therein.

Figure 5B:
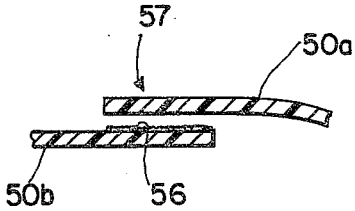
FIG. 5B is a detailed view of the resealable seam shown in FIG. 5A.

FIG. 5B shows a partial cross-section of the resealable closure 57, wherein the flexible material section designated as **50*a* overlaps the flexible material section 50*b* as provided by the overlappng seam 54. A non-hardening contact adhesive 56 is preferably applied to the upper surface of the section 50*b* to effect the pressure sensitive resealable closure 57, when the section 50*a* is contacted with the section 50*b*. The sections may be separated to provide access to the contents of the packet 50 by peeling the upper section 50*a* from the lower section 50*b***.

It is recognized that other means may also be used to form the resealable closure 57. For instance, a "zip lock" may be used wherein the overlapping portions of the closure 57 are made to elastically interlock.

It will be apparent that many modifications and variations may be effected without departing from the scope of and the novel concept of this invention. Therefore, it is intended by the appended claims to cover all such modifications and variations which fall within the true spirit and scope of the invention.

What is claimed is:

1. A moisture impermeable package for containing and dispensing moisture impregnated articles comprising:

a tray portion, for holding said articles, having a bottom and integral side walls extending upwardly therefrom and terminating in outwardly extending flanges;

a thin sheet of flexible material, having a single opening therein, sealed about said flanges of said tray portion to provide a moisture impermeable seal therebetween; and means for capping said opening in said flexible material and providing a moisture impermeable resealable closure for accessing and removing said articles contained in said package, wherein said capping means includes a resealable cap, a hinge portion and a circumferential collar, said hinge portion attaching said cap to said circumferential collar and wherein said collar is permanently mounted on said thin sheet of flexible material at said opening to provide a moisture impermeable seal therebetween, and further wherein said tray portion is a thermoform plastic material and said thin sheet of flexible material is aluminum foil.

2. A moisture impermeable package as in claim 1, wherein said moisture impregnated articles are a prefolded stack of towelettes.

3. A moisture impermeable package as in claim 1, wherein said thin sheet of flexible material is a vinyl film instead of aluminum foil.

* * * * *